US008984820B1

(12) United States Patent
Kownacki et al.

(10) Patent No.: US 8,984,820 B1
(45) Date of Patent: Mar. 24, 2015

(54) GEOMETRICS WINDOW SYSTEM

(76) Inventors: Charles D Kownacki, Erie, PA (US); Gregory N. Farrell, Waterford, PA (US)

( * ) Notice: Subject to any disclaimer, the term of this patent is extended or adjusted under 35 U.S.C. 154(b) by 46 days.

(21) Appl. No.: 13/345,917

(22) Filed: Jan. 9, 2012

(51) Int. Cl.
*E06B 3/00* (2006.01)
*E06B 3/54* (2006.01)

(52) U.S. Cl.
CPC ..... *E06B 3/5409* (2013.01)
USPC ..... 52/204.55; 52/204.54; 52/212

(58) Field of Classification Search
CPC ..... E06B 1/6007; E06B 1/02; E06B 1/6015; E06B 1/62; E06B 2003/4461; E06B 1/04; E06B 1/20; E06B 1/26; E06B 1/60; F24F 13/082; E04B 2002/7487; E04B 2/7435
USPC ..... 52/204.55, 204.5, 204.54, 212, 208, 52/204.53, 204.56
See application file for complete search history.

(56) References Cited

U.S. PATENT DOCUMENTS

| | | | | | |
|---|---|---|---|---|---|
| 2,303,739 | A * | 12/1942 | Hasenburger et al. | 52/210 |
| 2,319,245 | A * | 5/1943 | Just et al. | 49/65 |
| 2,934,798 | A * | 5/1960 | Thyer | 52/204.1 |
| 3,103,710 | A * | 9/1963 | Fredricksen | 52/211 |
| 3,609,928 | A * | 10/1971 | Mock | 52/210 |
| 4,281,481 | A * | 8/1981 | Wendt | 49/504 |
| 4,430,830 | A * | 2/1984 | Sailor | 52/211 |
| 4,989,381 | A * | 2/1991 | De Block et al. | 52/204.51 |
| 5,136,823 | A * | 8/1992 | Pellegrino | 52/539 |
| 5,222,343 | A * | 6/1993 | Anderson | 52/718.04 |
| 5,365,707 | A * | 11/1994 | Jones et al. | 52/211 |
| 5,369,922 | A * | 12/1994 | Hansen | 52/204.54 |
| 5,369,923 | A * | 12/1994 | Schilt | 52/208 |
| 5,491,936 | A * | 2/1996 | Logan et al. | 52/105 |
| 5,510,575 | A * | 4/1996 | Weibler | 174/381 |
| 5,636,484 | A * | 6/1997 | DeBlock | 52/204.5 |
| 6,058,667 | A * | 5/2000 | MacDonald et al. | 52/239 |
| 6,588,159 | B1 * | 7/2003 | Cotton, Jr. | 52/211 |
| 6,604,333 | B1 * | 8/2003 | Schiedegger et al. | 52/456 |
| 6,931,810 | B2 * | 8/2005 | Beaudoin et al. | 52/455 |
| 7,024,830 | B2 * | 4/2006 | Schiedegger et al. | 52/204.61 |
| 7,340,866 | B1 * | 3/2008 | Smith | 52/204.54 |
| 7,631,465 | B2 * | 12/2009 | Curtis | 52/204.1 |
| 8,490,350 | B1 * | 7/2013 | Greely et al. | 52/213 |
| 2002/0092248 | A1 * | 7/2002 | Westphal | 52/204.5 |
| 2003/0041539 | A1 * | 3/2003 | Bernacki et al. | 52/204.54 |
| 2005/0178079 | A1 * | 8/2005 | Hardman et al. | 52/208 |
| 2007/0283658 | A1 * | 12/2007 | Siewert et al. | 52/590.2 |
| 2008/0216424 | A1 * | 9/2008 | Westphal et al. | 52/204.5 |

* cited by examiner

*Primary Examiner* — Robert Canfield
*Assistant Examiner* — Babajide Demuren
(74) *Attorney, Agent, or Firm* — David S. Willoughby; MacDonald, Illig, Jones & Britton LLP

(57) ABSTRACT

An adaptable 3-piece, light-weight, adaptable window system, which can be installed by do-it-yourselfers in multiple unit arrays in various geometric patterns, includes a first polymeric molded window element with an outwardly extending mounting flange having a geometric profile that permits adjacent window units of the array of window units to interdigitate, aligning the adjacent window units and allowing the outwardly extending flange of each said adjacent window unit to be secured to a common intervening stud. The second and third window elements include exterior and interior trim portions.

29 Claims, 10 Drawing Sheets

GEOMETRICS WINDOW SYSTEM

BACKGROUND

The window system disclosed herein is an adaptable multi-piece window system that is configurable in a variety of geometric patterns and is installable between existing conventional wall studs without any need to re-configure the wall studs to receive the window system.

SUMMARY

What is presented is a window system that has a plurality of individual window units that are each installable between existing conventionally spaced wall studs. Each of the window units comprise a first window element that has a first jamb which is adapted for installation in the spacing between two individual studs of a standard wall. The first jamb has at least one flange that extends laterally from the first jamb. The flange has a profile through which the window unit is secured to an individual stud. The flange also has a profile that permits at least one other window unit in the window system to align adjacently to the flange in such a way that each adjacent window unit can secure to a common intervening stud. The flange could extend laterally from a front edge of the first jamb. The flange could also have a profile that permits additional window units in the window system to align adjacently in such a way that each flange of the adjacent window units interlock with each other. In some embodiments, each of the adjacent window units could also have their own corresponding flanges that can interlock with the flange in an interdigitative manner.

The window system also has a second window element that is adapted to cover the flange in such a way that said second window element forms an exterior wall finishing trim. The exterior wall finishing window trim could overlie and secure the edges of siding that surround the window unit. In some embodiments, the exterior wall finishing window trim could also comprise at least one exterior guide ridge that is used to facilitate the removal of potentially interfering trim portions of adjacent window units.

The window system could comprise a third window element that forms an integral interior wall trim that has at least one interior guide ridge used to facilitate the removal of interior trim portions on adjacent window units. This interior wall trim extends around the perimeter of the third window element and comprises a second jamb that overlaps the first jamb of the first window element in such a way that the second jamb enables the window system to accommodate varying wall thicknesses.

The first window element, the second window element, and the third window element could each be made from a polymer based plastic. The first window element, the second window element, and the third window element could each also be made from an injection molding process.

The method of installing the window system that has at least one individual window unit comprises, for each individual window unit in the window system, first, determining the location of individual studs on the interior side of a standard wall. Next, drawing markings of outlines of the window units on the interior side of a standard wall. Then, cutting and removing the interior side of the standard wall located between both of the individual studs and along the markings. Then, removing any insulation within the standard wall; drawing secondary markings of the outlines of the individual window units on the exterior side of the standard wall. Then, cutting and removing the exterior side of the standard wall located between both of the individual studs and along the secondary markings creating a hole through the standard wall. Finally, inserting a first window element into the hole on the exterior side of the standard wall; and affixing the first window element to the exterior side of the standard wall.

In some embodiments, the method of installation the window system could further comprise, overlying a second window element over the first window element such that the second window element covers the first window element. Next, affixing the second window element to the first window element and inserting a third window element into the hole from the interior side of the standard wall such that the first window element and the third window element overlap within the hole. Finally, affixing the third window element to the interior side of the standard wall.

In some embodiments, the method of installation of the window system could comprise, for each additional adjacent window unit, determining the location of additional studs that are adjacent to the hole on the interior side of a standard wall. Next, drawing adjacent markings of outlines of adjacent window units on the interior side of a standard wall. Then, cutting and removing the interior side of the standard wall located between both of the additional studs and along the adjacent markings; drawing adjacent secondary markings of the outlines of the adjacent window units on the exterior side of the standard wall. Then, cutting and removing the exterior side of the standard wall located between both of the additional studs and along the adjacent secondary markings creating adjacent holes through the standard wall. Then, inserting at least one adjacent first window element into an adjacent hole on the exterior side of the standard wall; affixing each adjacent first window element to the exterior side of the standard wall. Then, overlying an adjacent second window element over each adjacent first window element such that each adjacent second window element covers each adjacent first window element. Then, affixing each adjacent second window element to each adjacent first window element. Then, inserting an adjacent third window element into the hole from the interior side of the standard wall such that each adjacent first window element and the adjacent third window element overlap within the hole and affixing the adjacent third window element to the interior side of the standard wall.

DETAILED DESCRIPTION

Figure 1:
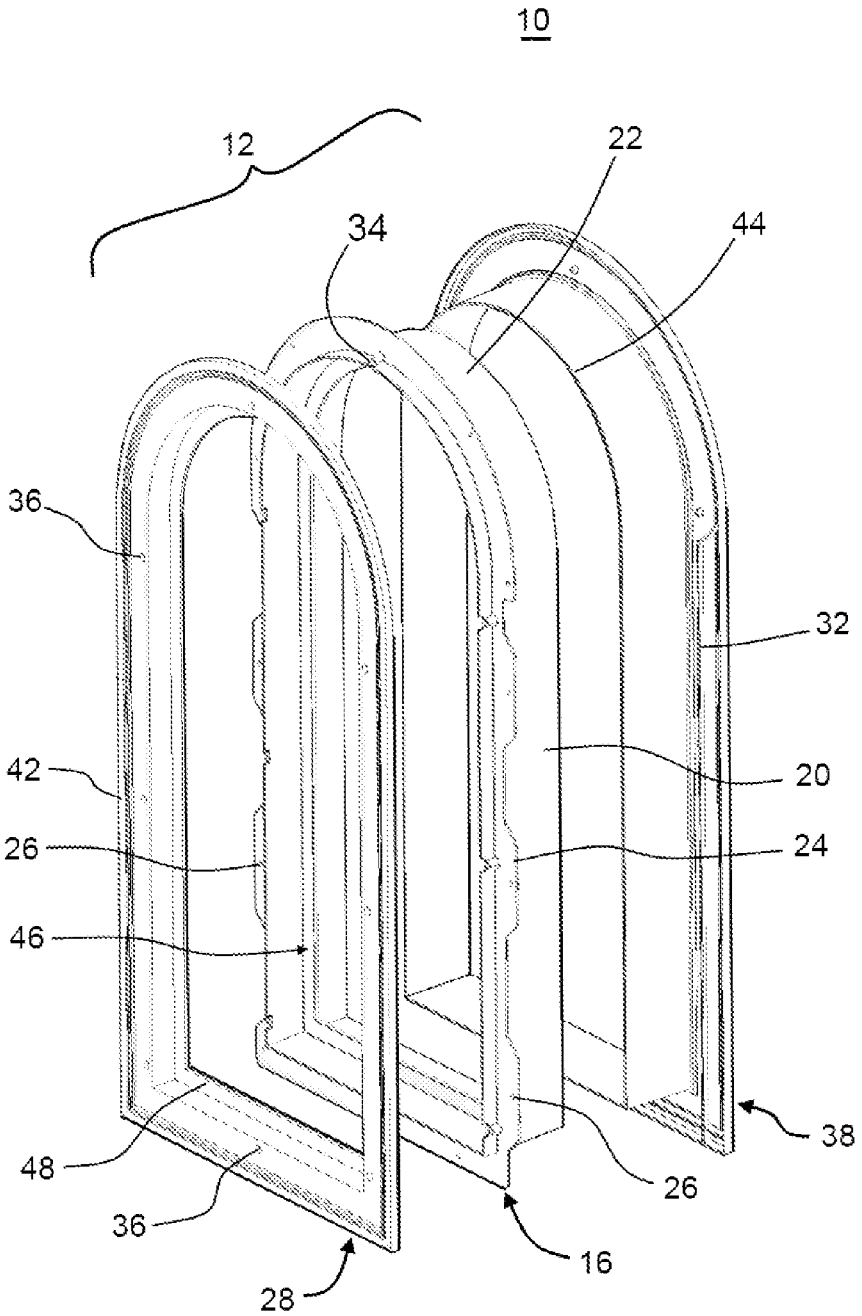
FIG. 1 is an exploded perspective view of the assembly of the window unit.

Referring to the drawings, some of the reference numerals are used to designate the same or corresponding parts through several of the embodiments and figures shown and described. Corresponding parts are denoted in different embodiments with the addition of lowercase letters. Variations of corresponding parts in form or function that are depicted in the figures are described. It will be understood that variations in the embodiments can generally be interchanged without deviating from the invention.

As shown in FIG. 1, a window system 10 comprises individual window units 12 that are installed between existing conventionally spaced wall studs on a standard wall (as discussed later in more detail). Typically each window unit 12 comprises three window elements: a first window element 16, a second window element 28, and a third window element 38. The first window element 16 is installed on the exterior side of a standard wall (not shown) between the second window element 28 and the third window element 38. The second window element 28 is installed over the first window element 16 on the exterior side of a standard wall to form an exterior finishing trim. The third window element 38 is installed on the interior side of a standard wall to form an integral interior finishing trim. It will be obvious to one having ordinary skill in the art that the window unit 12 could comprise additional window elements.

In the preferred embodiment, a polymer based plastic formed through an injection molding process creates each of the window elements 16, 28, and 38. One of ordinary skill in the art will see that any material able to withstand the normal installation and usage of the window system 10 (e.g. wood, titanium, steel, aluminum, etc.) can also create the window elements 16, 28, and 38. One of ordinary skill in the art will also see that any process that can effectively form each of the window elements 16, 28, and 38 may work.

Figure 2A:
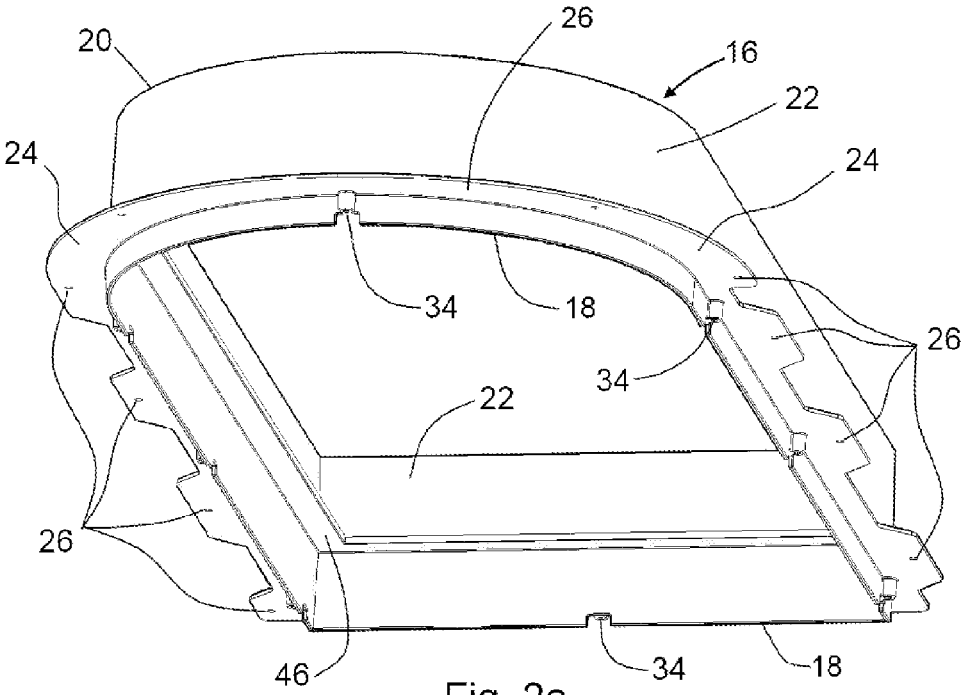
FIG. 2*a* is a top down perspective view of the first window element of the window unit.

As shown in FIG. 2*a*, the first window element 16 has a front edge 18 and a back edge 20 with a first jamb 22 that begins near the front edge 18 and extends to the back edge 20. When the first window element 16 is installed on a standard wall, the first jamb 22 extends into a hole that goes through the standard wall. The first jamb 22 is a part of the structural support of the first window element 16. The first jamb 22 has a first glazing unit 46 that protrudes laterally from its inner circumference as will be discussed later.

A flange 24 extends laterally along the perimeter of the front edge 18 of the first window element 16. The flange 24 has a profile though which a plurality of joining mechanisms (not shown) permanently secure the window unit 12 to existing conventionally spaced wall studs. A series of pre-drilled holes 26 are spaced along the body of the flange 24. The pre-drilled holes 26 allow these joining mechanisms to secure the window unit 12 to the wall studs.

Figure 2B:
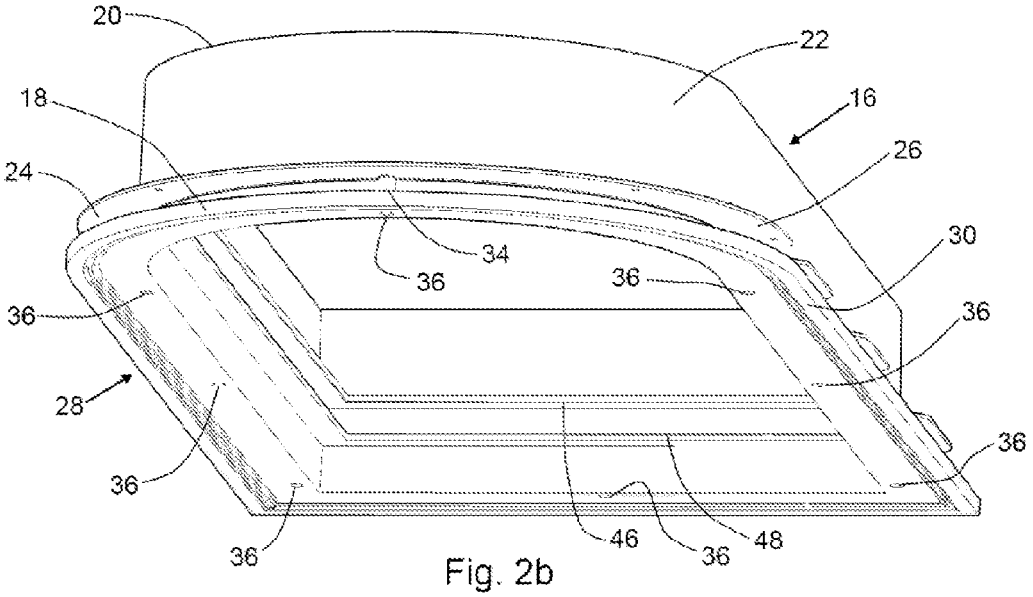
FIG. 2*b* is a top down perspective view of the first and second window elements.

A series of recesses 34 are located on the front edge 18 of the first window element 16. These recesses 34 help guide the second window element 28 over the first window element 16 and into its respective location in the window unit 12. As shown in FIG. 2*b*, Once the second window element 28 has been guided into place, the second window element 28 can be permanently secured to the first window element 16 through a plurality of secondary pre-drilled joining holes 36. The secondary pre-drilled joining holes 36 are located along the body of the second window element 28. In this preferred embodiment, screws permanently secure the second window element 28 to the first window element 16. Any method that permanently secures the second window element 28 to the first window element 16 may work such as nails, bolts, glue, caulk, etc.

A second glazing unit 48 protrudes laterally from the inner circumference of the second window element 28. Together, the first glazing unit 46 and the second glazing unit 48 create a clamping mechanism that holds a window pane (not shown) in a stationary manner after the window pane has been permanently installed within the window unit 12 as discussed later in greater detail.

An exterior wall finishing trim 30 portion of the second window element 28 extends laterally from the second window element 28 and is adapted to cover the flange 24 of the first window element 16. The exterior wall finishing trim 30 overlies and secures edges of the exterior wall (i.e. brick, siding, wood paneling, etc.) surrounding the window unit 12 such that it covers all gaps between the exterior side of a standard wall and the window unit 12. The exterior wall finishing trim 30 is also useful in keeping small rodents or insects from inhabiting these gaps or finding their way into the facility in which the window unit 12 is installed. The exterior wall finishing trim 30 can also be used for cosmetic purposes and echo the architectural style of the facility on which the window unit 12 is installed.

Figure 3:
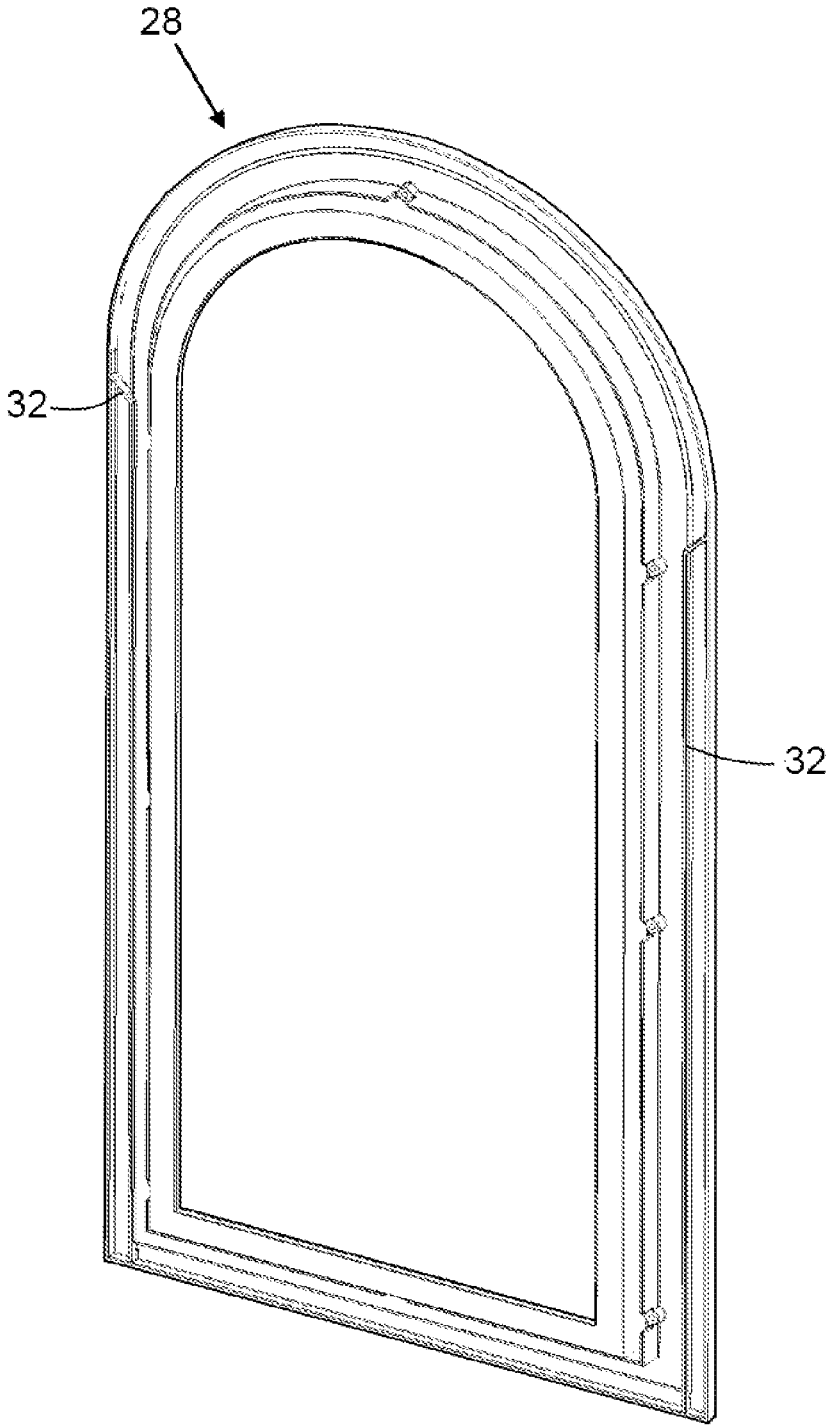
FIG. 3 is a perspective view of the reverse side of the second window element.

As shown in FIG. 3, the second window unit 28 has an exterior guide ridge 32 that runs along the reverse side of the exterior wall finishing trim 30. The exterior guide ridge 32 is used to facilitate the removal of potentially interfering trim 30 portions of any adjacent window units that are to be installed within the window system 10. As shown in more detail later, removing interfering trim 30 portions allow for any adjacent exterior wall finishing trim on the adjacent window units to fit snugly with adjacent window units 12 without any kind of interferences or unnecessary overlap.

Figure 2C:
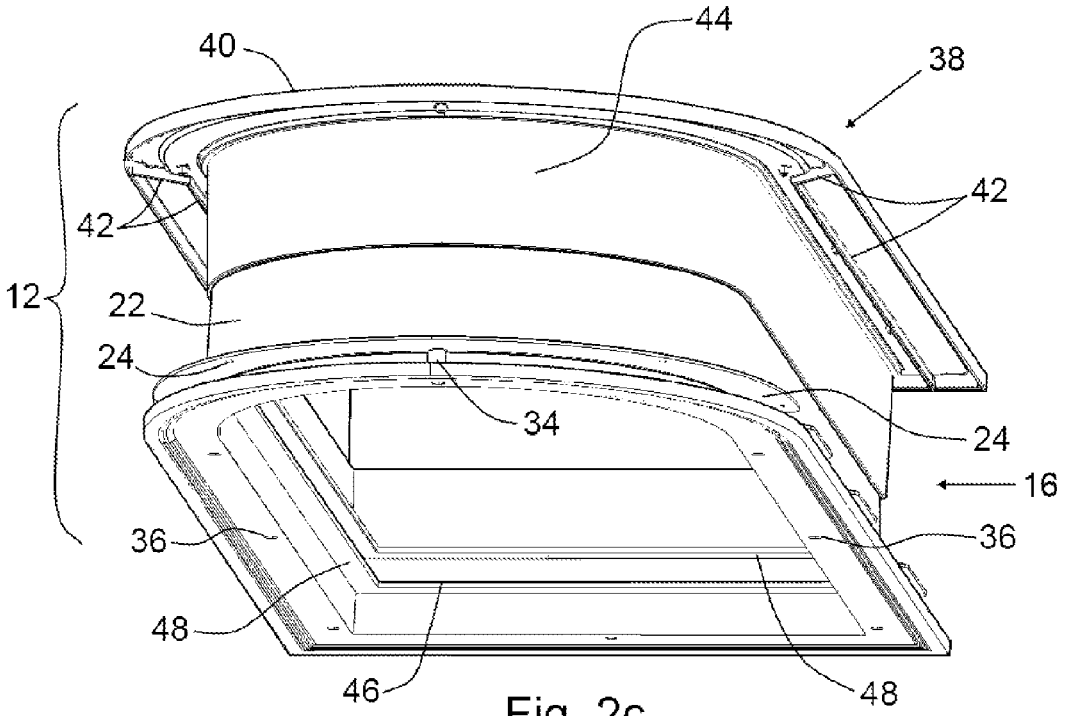
FIG. 2*c* is a top down perspective view of the first, second and third window elements.
Figure 4:
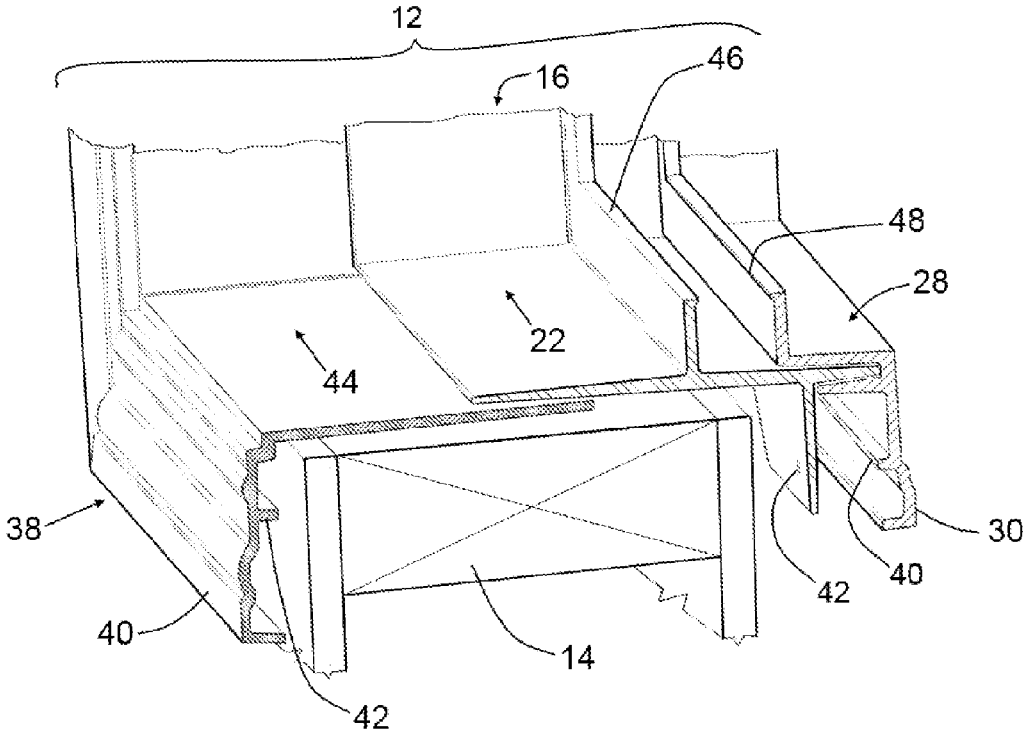
FIG. 4 is a cross-sectional perspective side view of the window unit as assembled and as installed.

As shown in FIG. 2*c*, the third window element 38 joins to the first window element 16 at the back edge 20 of the first window element 16. To join to the first window element 16, the third window element 38 has a second jamb 44 which parallels the first jamb 22. When joined, the second jamb 44 overlaps a portion of the first jamb 22 which is just beyond the back edge 20 of the first jamb 22. As best shown by comparing FIGS. 2*c* and 4, the second jamb 44 overlaps the first jamb 22 within the hole of standard that creates the window. The second jamb 44 also overlaps the first jamb 22 in such a way that the second jamb 44 enables the window system 10 to accommodate varying wall thicknesses.

Typically the window unit 12 is installed with walls having thicknesses ranging somewhere between 4½ inches and 6⁹⁄₁₆ inches by adjusting the overlap between the first jamb 22 and the second jamb 44 to accommodate the wall design. It is also obvious to one having skill in the art that the window units 12 can easily be manufactured to accommodate wall thicknesses that fall outside a range between 4½ inches and 6⁹⁄₁₆ inches.

Together, the first jamb 22 and the second jamb 44 create a support structure for the entire window unit 12. In this preferred embodiment, the first jamb 22 and the second jamb 44 are joined together permanently through the application of caulk in and around a seam that is created by the overlapping jambs. It is obvious to one having skill in the art that any method of permanently joining these two jambs may work such as screws, nails, glue, bolts, etc.

Referring again to both FIGS. 2*c* and 4, an integral interior wall trim 40 portion is formed on the third window element 38. Similar to the exterior wall finishing trim 30, the interior wall trim 40 overlies and secures edges surrounding the window unit 12 such that it covers all gaps between the interior side of a standard wall and the window unit 12. The interior wall trim 40 typically has even more of a cosmetic appeal than the exterior wall trim 30 and can reflect the architecture of the room in which it is installed. The third window unit 38 has an interior guide ridge 42 that runs along the reverse side of the interior wall trim 40 and helps to facilitate the removal of interior wall trim 40 portions on adjacent window units. As shown and discussed in more detail later, removing these interfering interior trim 40 portions allows for any adjacent interior wall trim on adjacent window units to fit snugly against the window unit 12 and without unnecessary interference or overlap.

Figure 5:
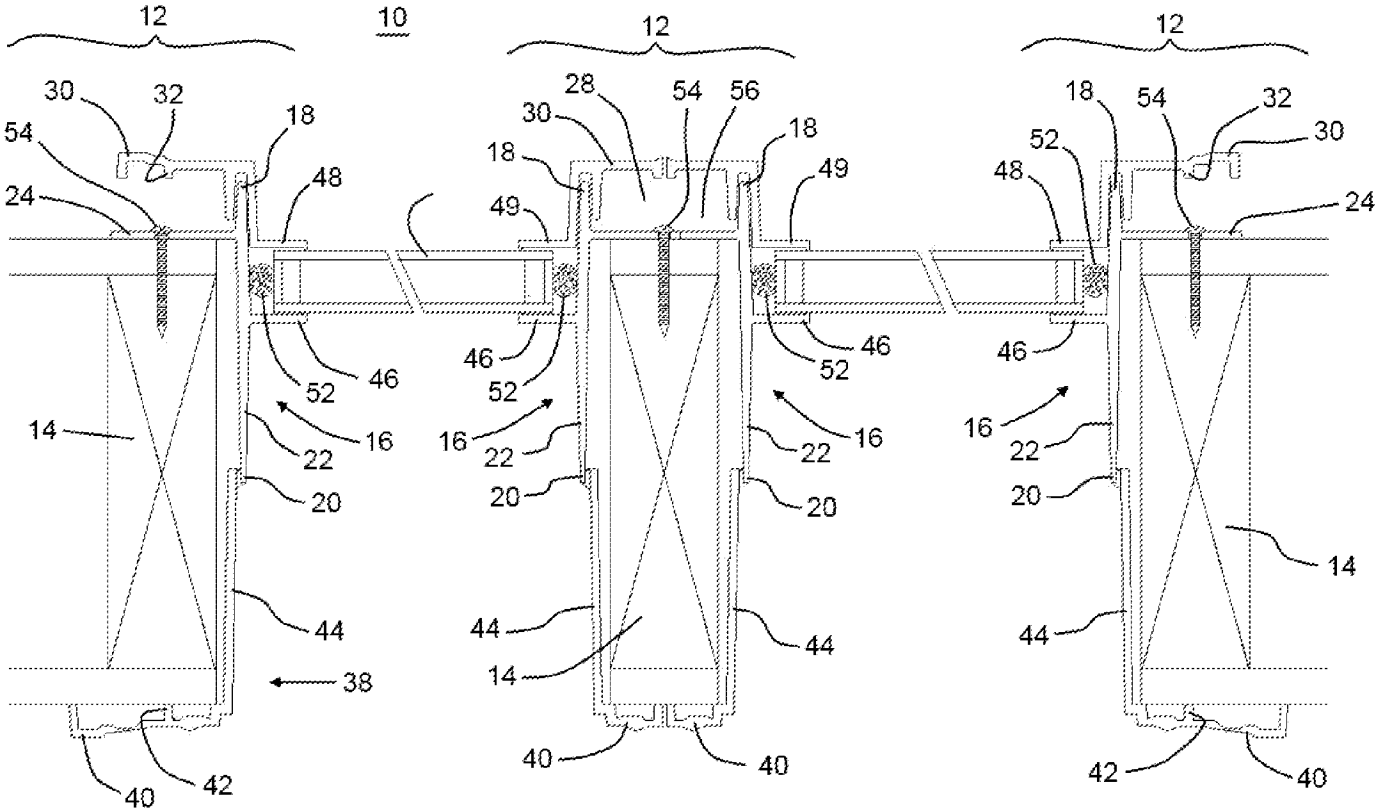
FIG. 5 is a top down cross-section of conventionally spaced wall studs showing multiple window units as assembled and as installed.

As shown in FIG. 5, a window pane 50 is permanently installed within each of the window units 12 of the window system 10. As briefly explained earlier, the window pane 50 is held in place between the first glazing unit 46 that is located on the first window element 16 and the second glazing unit 48 that is located on the second window element 28. In conjunction, both the first glazing unit 46 and second glazing unit 48 hold the window pane 50 in place by clamping the window pane 50 from both its interior facing and exterior facing sides. A foam strip 52 is adhered to the first window element 16 and is located in the crevice between the first glazing unit 46 and the second glazing unit 48. The foam strip 52 wedges between the window pane 50 and the window unit 12 and cushions the window pane 50 from directly rubbing against the window unit 12. This cushioning effect prevents potential damage to the window pane 50 during and after installation. One of ordinary skill in the art will see other ways to install a window pane 50 such that it can remain completely stationary and/or prevent damage.

Figure 6A:
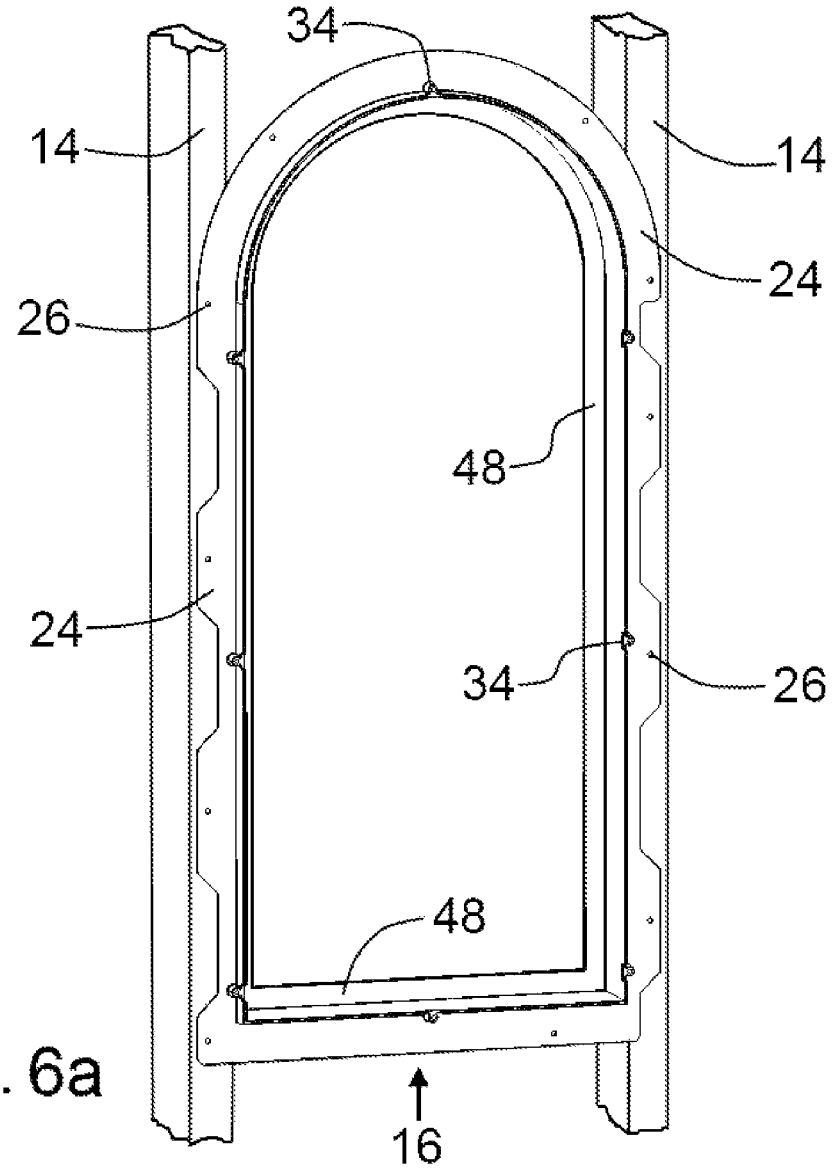
FIG. 6*a* is a front perspective view of the first window element of a single window unit as installed between two conventionally spaced wall studs.

As shown in FIG. 6*a*, the first window element 16 is adapted for installation in the spacing between two individual conventional wall studs 14 on a standard wall (not shown). The first window element 16 is installed between the wall studs 14 through each flange 24. A joining mechanism (not shown) is inserted into the wall studs 14 through the series of pre-drilled holes 26. Typically the first window element 16 is installed on the wall by using screws or nails, however, any joining mechanism that can permanently install the first window element 16 may work.

A substantial portion of the first jamb 22 runs parallel with the wall studs 14. The first jamb 22 is designed to fit snug against each individual wall stud 14. Typically the window system 10 is designed to fit between wall studs having 16" or 24" centers. Each individual window unit 12 in the window system 10 can be custom made to fit between studs 14 having non-traditionally spaced centers. Even though it is preferable for structural purposes, the first jamb 22 does not have to fit snug against each individual wall stud 14.

Figure 6B:
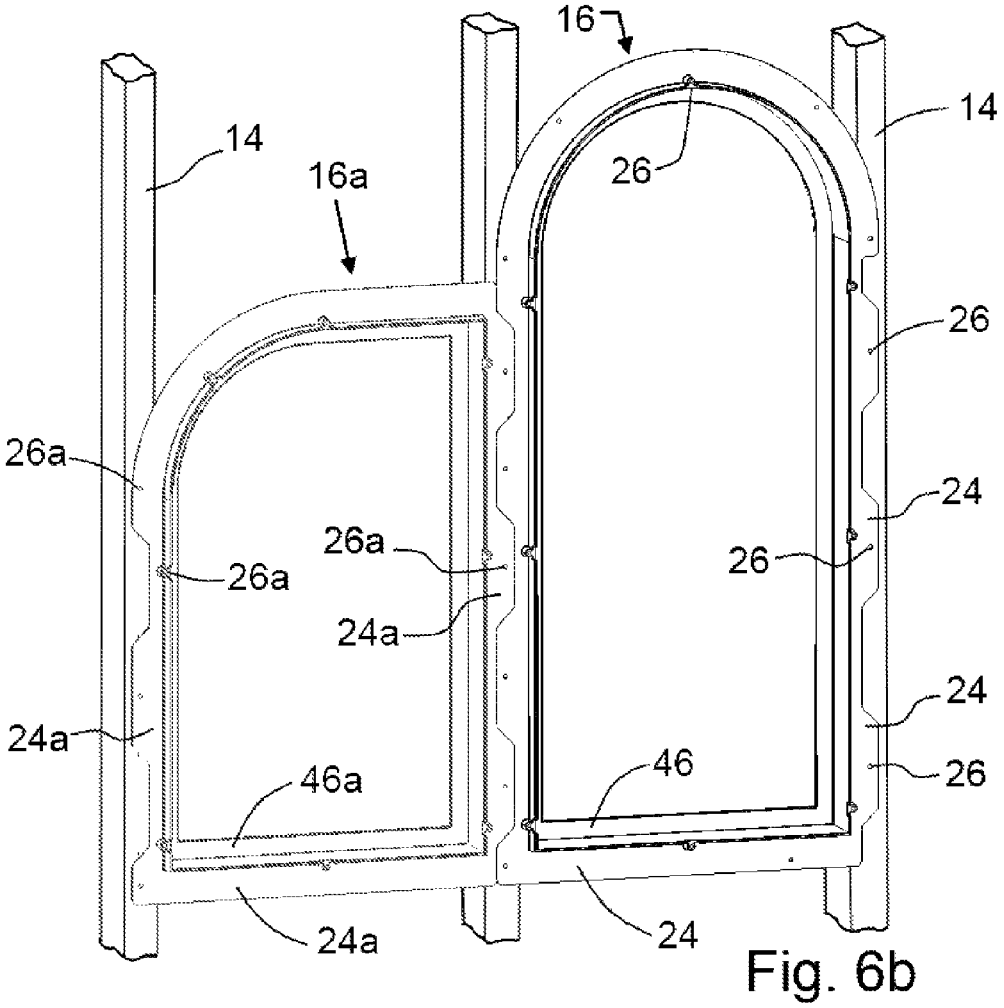
FIG. 6*b* is a front perspective view of the first window element of two adjacent window units as installed between two conventionally spaced wall studs.
Figure 6C:
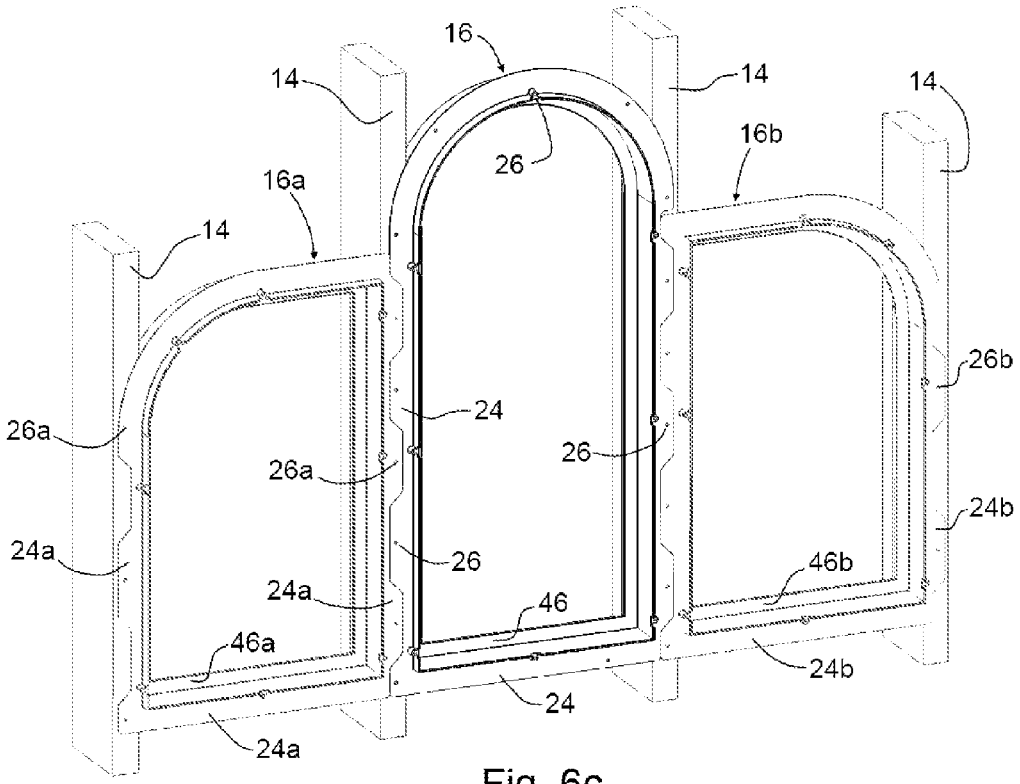
FIG. 6*c* is a front perspective view of the first window element of three adjacent window units as installed between two conventionally spaced wall studs.

As shown in both FIGS. 6*b* and 6*c*, the flange 24 has a profile that permits additional window units 12*a* and 12*b* in the window system 10 to align in an adjacent manner. These additional window units 12*a* and 12*b* can align such that that each of the adjacent window units 12*a* and 12*b* are to be secured to a common intervening wall stud 14. Typically, adjacent window units 12*a* and 12*b* are secured to a common intervening wall stud 14 such that each interlock with each other. In this preferred embodiment, each flange 24 has a profile that permits additional window units 12*a* and 12*b* to align in an interdigitative manner. One of ordinary skill in the art will see that flanges 24 only need to allow the window units 12*a* and 12*b* to align adjacently such that each of the adjacent window units 12*a* and 12*b* can secured to a common intervening wall stud 14. Various means of alignment will be obvious to one having ordinary skill in the art. One of ordinary skill in the art will also see that the window units 12*a* and 12*b* can align adjacently such that the window units 12*a* and 12*b* align horizontally, vertically, or in any other adjacent alignment configuration to window unit 12.

Referring generally to FIGS. 6*a* through 6*d*, the window system 10 installs between existing conventionally spaced wall studs 14, through the installation of each window unit 12 individually, and in any conventional wall without the need to reconfigure any wall studs to secure each window unit 12. Installation of the window system 10 is done easily by, before anything else, accurately determining the location of individual studs 14 on the interior side of a standard wall where the window system is to be installed. Markings are drawn of an outline of an individual window unit 12, on the interior side of a standard wall, then the appropriate inner wall portions are cut and removed from between both individual studs 14 along the markings. Next, markings are drawn outlining each additional adjacent window unit 12*a*, 12*b*, on the interior side of a standard wall. The appropriate inner wall portions relative to each adjacent window unit 12*a* and 12*b* are also cut out and removed. After removing all inner wall portions from the standard wall, insulation, electrical wiring, plumbing, television or phone cables, etc., that is present in the intended window location are also removed or removed and relocated before taking any subsequent steps. Lastly, drilling a number of location holes in the corners of the opening through the exterior sheathing before taking any subsequent steps.

On the exterior side of the standard wall, secondary markings of the outline of the individual window unit 12 are drawn in the corresponding exterior location. Then, all secondary markings of the outline of each additional adjacent window units 12*a* and 12*b* are drawn in their respective exterior locations. Then all exterior portions on the exterior side of the standard wall are removed to create a hole through the standard wall but leaving the wall studs 14 in place.

After creating a hole for each window unit, the first window element 16 is inserted into the hole from the exterior side of the standard wall and affixed to the exterior side of the wall studs as shown in FIG. 6*a*. Next, for each adjacent window unit, each adjacent first window element 16*a* and 16*b* is inserted into the hole from the exterior side of the standard wall and then each adjacent first window element 16*a* and 16*b* is affixed to the exterior side of the standard wall as shown in FIG. 6*c*.

Figure 6D:
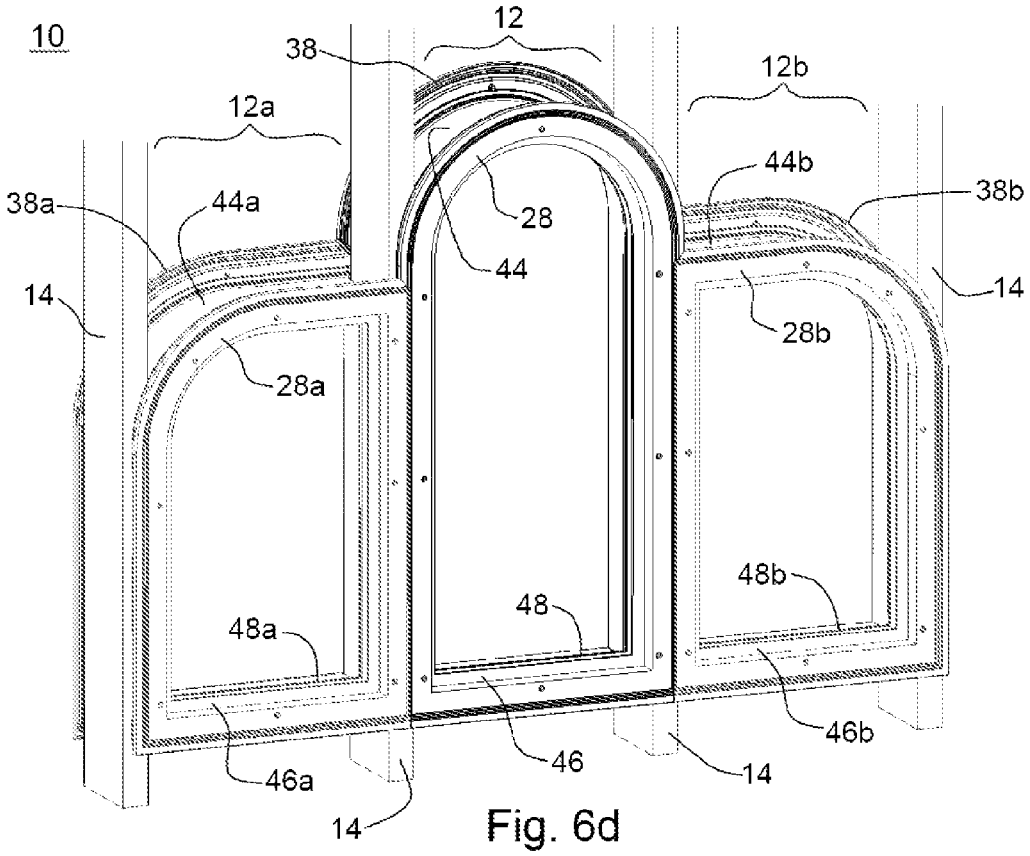
FIG. 6*d* is a front perspective view of the three window units as installed between conventionally spaced wall studs.

As shown in FIG. 6*d*, for each window unit, a second window element 28 is laid over the first window element 16 such that the second window element 28 covers the first window element 16 and then the second window element 28 is affixed to the first window element 16. For each of the adjacent window units, each adjacent second window elements 28*a* and 28*b* are laid over each adjacent first window elements 16*a* and 16*b* such that each adjacent second window elements 28*a* and 28*b* cover the adjacent first window elements 16*a* and 16*b* and then each adjacent second window element 28*a* and 28*b* is affixed to each adjacent first window elements 16*a* and 16*b*. For each window unit, a third window element 38 is inserted into the hole from the interior side of the standard wall in such a way that the first window element 16 and the third window element 38 overlap within the hole. The third window element 38 is affixed to the interior side of the standard wall in such a way that the third window element 38 joins to the first window element 16. For each adjacent window unit, each adjacent third window element 38*a* and 38*b* is inserted into the hole from the interior side of the standard wall in such a way that each adjacent first window element 16*a* and 16*b* and the adjacent third window elements 38*a* and 38*b* overlap within the hole. Finally, each adjacent third window element 38*a* and 38*b* is affixed to the interior side of the standard wall in such a way that the adjacent third window elements 38*a* and 38*b* join to each adjacent first window element 16*a* and 16*b*.

This invention has been described with reference to several preferred embodiments. Many modifications and alterations will occur to others upon reading and understanding the preceding specification. It is intended that the invention be construed as including all such alterations and modifications in so far as they come within the scope of the appended claims or the equivalents of these claims.

We claim:

1. A window unit installed between existing conventionally spaced wall studs, said window unit comprising:

a first window element having a first jamb, said first window element installed in the spacing between two individual studs of a standard wall;

said first jamb having at least one flange extending laterally from said first jamb;

said at least one flange having a profile through which a joining mechanism is driven to secure said first window element to at least one individual stud of the standard wall;

a second window element installed over said at least one flange, said second window element forms an exterior wall finishing trim;

a third window element joined to the back edge of said first window element and forming an integral interior wall trim; and a foam strip between said first window element and said second window element.

2. The window unit of claim 1 further comprising said first window element is made from a polymer based plastic.

3. The window unit of claim 1 further comprising said first window element is made from an injection molding process.

4. The window unit of claim 1 further comprising said second window element is made from an injection molding process.

5. The window unit of claim 1 further comprising said second window element is made from a polymer based plastic.

6. The window unit of claim 1 further comprising said at least one flange extending laterally from a front edge of said first jamb.

7. The window unit of claim 1 further comprising a window pane permanently installed within said window unit.

8. The window unit of claim 1 wherein said third window element is made from an injection molding process.

9. The window unit of claim 1 wherein said third window element is made from a polymer based plastic.

10. The window unit of claim 1 wherein said interior wall trim extends around the perimeter of said first window element and comprises a second jamb that overlaps said first jamb of said first window element such that said second jamb enables said window system to accommodate varying wall thicknesses.

11. A window system having a plurality of individual window units that are installed between existing conventionally spaced wall studs, each window unit comprising:

a first window element having a first jamb, said first window element installed in the spacing between two individual studs of a standard wall;

said first jamb having at least one flange extending laterally from said first jamb;

said at least one flange having a profile through which a joining mechanism is driven to secure said first window element to at least one individual stud of the standard wall;

said at least one flange having a profile that permits at least one other window unit in said window system to align adjacently to said at least one flange, each adjacent other window unit is secured to a common intervening stud;

a second window element installed over said at least one flange, said second window element forms an exterior wall finishing trim; and a third window element; and a foam strip between said first window element and said second window element joined to the back edge of said first window element and forming an integral interior wall trim.

12. The window system of claim 11 further comprising said first window element is made from a polymer based plastic.

13. The window system of claim 11 further comprising said first window element is made from an injection molding process.

14. The window system of claim 11 further comprising said second window element is made from an injection molding process.

15. The window system of claim 11 further comprising said second window element is made from a polymer based plastic.

16. The window system of claim 11 further comprising said at least one flange extending laterally from a front edge of said first jamb.

17. The window system of claim 11 further comprising said at least one flange having a profile permitting additional window units of said window system to align adjacently such that each said at least one flange of said adjacent window units interlock with each other.

18. The window system of claim 11 further comprising each of said adjacent window units have corresponding flanges that can interlock with said at least one flange.

19. The window system of claim 11 further comprising each of said adjacent window units have corresponding flanges that can interlock with said at least one flange in an interdigitative manner.

20. The window system of claim 11 further comprising said exterior wall finishing window trim overlies and secures edges of siding surrounding said window unit.

21. The window system of claim 11 further comprising said exterior wall finishing window trim overlies and secures edges of siding surrounding said window unit; said exterior wall finishing window trim further comprises at least one exterior guide ridge facilitating removal of potentially interfering trim portions of said window units.

22. The window system of claim 11 wherein said third window element is made from an injection molding process.

23. The window system of claim 11 wherein said third window element is made from a polymer based plastic.

24. The window system of claim 11 wherein said third window element further comprises at least one interior guide ridge to facilitate removal of interior trim portions on adjacent window units.

25. The window system of claim 11 wherein said third window element is joined to said first window element at the back edge of said first window element and said third window element further comprises at least one interior guide ridge to facilitate removal of interior trim portions on adjacent window units; and said interior wall trim extends around the perimeter of said third window element and comprises a second jamb that overlaps said first jamb of said first window element such that said second jamb enables said window system to accommodate varying wall thicknesses.

26. A window system having a plurality of individual window units that are installable between existing conventionally spaced wall studs comprising:

a polymeric plastic molded first window element having a first jamb; said first jamb of said first window element is adapted for the installation in the spacing between two individual studs of a standard wall;

a window pane permanently installed within said first window element;

a flange extending laterally along the perimeter and from a front edge of said first jamb; said flange having a profile through which said window unit is secured to at least one individual stud;

said flange having a profile that permits at least one other window unit in said window system to align adjacently such that each other window unit has corresponding flanges that abut snugly against said flange in a gapless interdigitative manner and each other window unit can secure to a common intervening stud;

a polymeric plastic molded second window element adapted to cover said flange; wherein said second window element forms an exterior wall finishing, trim which covers and secures edges of siding surrounding said window unit; said exterior wall finishing window trim further comprises at least one exterior guide ridge facilitating removal of potentially interfering trim portions of said window units;

a polymeric plastic molded third window element forming an integral interior wall trim; said third window element further comprises at least one interior guide ridge to facilitate removal of interior trim portions on adjacent window units;

said interior wall trim extends around the perimeter of said first window element; and comprises a second jamb which overlaps said outer wall portion enabling said window system to accommodate varying wall thicknesses; and a foam strip between said polymeric plastic molded first window element and said polymeric plastic molded second window element.

27. The window unit of claim 1 wherein said joining mechanism is a nail, screw, or bolt.

28. The window system of claim 11 wherein said joining mechanism is a nail, screw, or bolt.

29. The window system of claim 26 wherein said joining mechanism is a nail, screw, or bolt.

* * * * *